US007258312B2

(12) United States Patent
Grosse

(10) Patent No.: US 7,258,312 B2
(45) Date of Patent: Aug. 21, 2007

(54) BUCKET STABILIZING APPARATUS

(76) Inventor: Joel H. Grosse, 8500 Greenwood Ave., No. 2, Takoma Park, MD (US) 20912

( * ) Notice: Subject to any disclaimer, the term of this patent is extended or adjusted under 35 U.S.C. 154(b) by 2 days.

(21) Appl. No.: 11/368,852

(22) Filed: Mar. 6, 2006

(65) Prior Publication Data

US 2006/0202093 A1 Sep. 14, 2006

Related U.S. Application Data

(60) Provisional application No. 60/659,732, filed on Mar. 9, 2005.

(51) Int. Cl.
*A47G 23/02* (2006.01)

(52) U.S. Cl. ..... 248/154; 248/500; 248/213.2; 366/349

(58) Field of Classification Search ..... 248/154, 248/500, 213.2; 220/628–630; 366/349, 366/129

See application file for complete search history.

(56) References Cited

U.S. PATENT DOCUMENTS 466,895 A * 1/1892 Perkins ..... 15/259
624,343 A * 5/1899 Kirk ..... 248/154
763,653 A * 6/1904 Bailey ..... 249/164
4,044,723 A * 8/1977 Fitzpatrick ..... 119/61.5
4,819,803 A * 4/1989 Neiser ..... 206/423
4,826,007 A * 5/1989 Skeie ..... 206/373
4,877,208 A * 10/1989 Kennard, Jr. ..... 248/146
5,232,187 A * 8/1993 O'Farrell et al. ..... 248/148
6,361,001 B1 * 3/2002 Durand ..... 248/146
6,464,184 B1 * 10/2002 Lytle ..... 248/126
6,779,915 B2 8/2004 Foster
6,815,036 B1 * 11/2004 Romero ..... 428/99
2003/0016586 A1 1/2003 Williams
2003/0189873 A1 10/2003 Moore
2003/0223306 A1 12/2003 Foster
2004/0021043 A1 * 2/2004 Zagorsky ..... 248/146
2004/0094688 A1 * 5/2004 Michel et al. ..... 248/680
2005/0045780 A1 * 3/2005 Forshee et al. ..... 248/146
2006/0124808 A1 * 6/2006 Hibbler ..... 248/146

* cited by examiner

*Primary Examiner*—Anita King
*Assistant Examiner*—Michael McDuffie
(74) *Attorney, Agent, or Firm*—Lawrence E. Laubscher, Sr.; Lawrence E. Laubscher, Jr.

(57) ABSTRACT

A two-part bucket stabilizing apparatus for use with cylindrical joint compound buckets or the like during the mixing of the contents thereof includes a horizontal base member containing an opening for receiving the bottom of the bucket, and a support member having a first edge portion pivotally connected with the base member, and a remote edge portion containing a semi-circular recess. The support member is pivotally operable from an initial horizontal position upwardly and inwardly toward a clamping position above the base portion in which the wall of the semi-circular recess is in clamping engagement with the outer circumferential wall surface of the bucket.

6 Claims, 2 Drawing Sheets

BUCKET STABILIZING APPARATUS

CROSS REFERENCE TO RELATED APPLICATIONS

In accordance with the provisions of 35 U.S. Code § 119(e)(1), this application claims priority of the Provisional Application No. 60/659,732 filed Mar. 9, 2005.

BACKGROUND OF THE INVENTION

1. Field of the Invention

A two-piece bucket stabilizing apparatus for use with cylindrical joint compound buckets or the like during the mixing of the contents thereof includes a horizontal base member containing an opening for receiving the bottom of the bucket, and a support member having a first edge portion pivotally connected with the base member, and a remote edge portion containing a semi-circular recess. The support member is pivotally operable from a horizontal position toward a clamping position above the base portion, whereupon the wall of the semi-circular recess is brought into clamping engagement with the outer circumferential wall surface of the bucket.

2. Description of Related Art

Various types of devices have been proposed in the patented prior art for stabilizing a bucket during the stirring and mixing of the viscous contents thereof, such as joint compound, coatings, sealers and the like. In each of the patents to Kennard U.S. Pat. No. 4,877,208, and Foster U.S. Pat. No. 6,779,915, and in the Forshee et al Published Application No. US 2005/0045780, the bucket to be stirred is inserted into an opening contained in a support device upon which the user stands. In the Zagorsky Published Patent Application No. US 2004/0021043, the planar clamping device contains an opening that receives the bucket, and clip and chain means support the planar member at an angle from the top edge of the bucket. In the Lytle U.S. Pat. No. 6,464,184, the bucket to be mixed is supported on a base that includes a plurality of sections that are adjustable to correspond with the size of the bucket, together with at least one swing member that is biased by spring means toward an open position relative to the base, and upon which the user stands. In the Durand U.S. Pat. No. 6,361,001, a unitary tubular container holder slips concentrically downwardly over the bucket to be stirred, and a pair of outwardly extending foot portions are provided upon which the user stands to steady the bucket.

These known devices are relatively complex, require a large number of parts, and are expensive to produce. The present invention was developed to provide a simple two-part light-weight inexpensive bucket stabilizing device that includes only a single base member and a single pivotally-connected clamping member.

SUMMARY OF THE INVENTION

Accordingly, a primary object of the present invention is to provide a bucket stabilizing device for stabilizing a cylindrical bucket during the mixing of the fluid viscous contents of the bucket, use being made of a horizontal base member containing a circular opening for receiving the bottom of the bucket, and a pivotally connected support member having a remote edge portion containing a semi-circular recess operable to engage in clamping relation a portion of the outer circumferential surface of the bucket. Consequently, when the support member is pushed downwardly relative to the base member by the foot of the user, the wall of the semi-circular recess engages and steadies the bucket as the operator stirs the contents thereof with a suitable stirring device.

According to a more specific object of the invention, the distance between the semi-circular recess in the support member and the pivot axis is greater than the distance between the circular opening in the base member and the pivot axis means, thereby to produce the desired clamping operation. The pivot means preferably comprises a piano hinge, and the base and support members are formed from a rigid material that will support the user's weight when standing on the support member. While the base and support members are preferably formed from a suitable durable synthetic plastic material, such as polyvinyl chloride or the like, the members could be formed of metal or wood as well.

The invention is particularly suitable for stabilizing large buckets, such as a five gallon bucket, during the mixing of the fluid contents thereof, such as joint compound, paint, roof coatings, driveway sealers, and the like.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
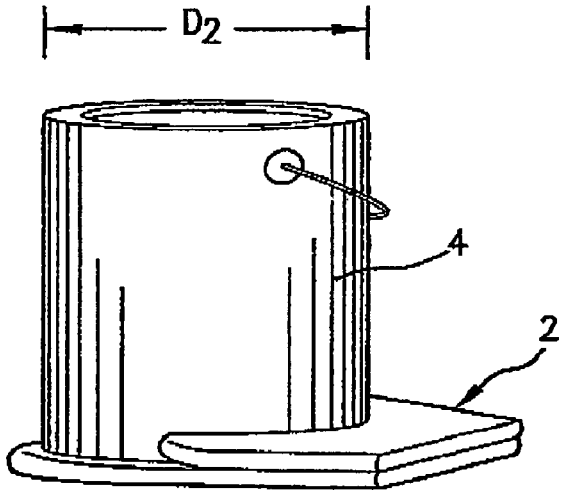
FIG. 1 is a perspective view illustrating the use of the bucket stabilizing apparatus of the present invention when in the clamping position for stabilizing a joint compound bucket during the mixing of the contents thereof.
Figure 2:
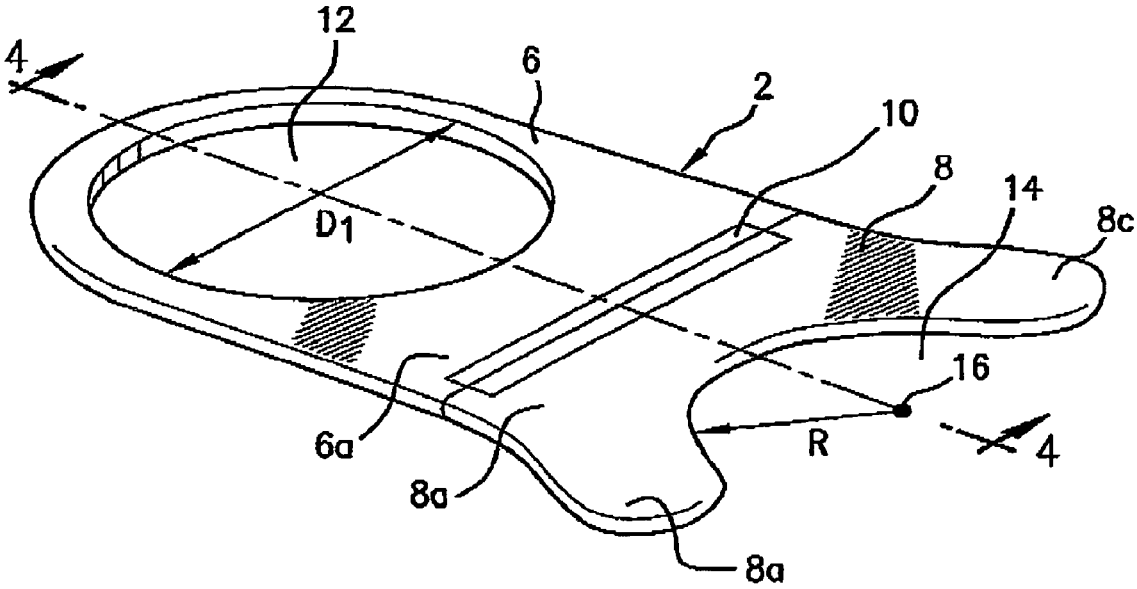
FIG. 2 is a perspective of the bucket stabilizing apparatus when in the fully open condition.
Figure 3:
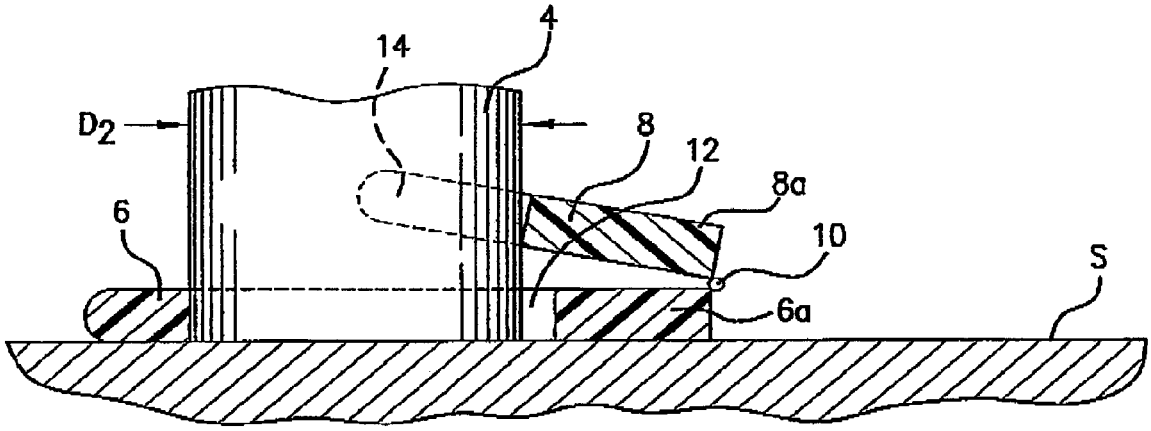
FIG. 3 is a sectional view of the apparatus of FIG. 1.
Figure 4:
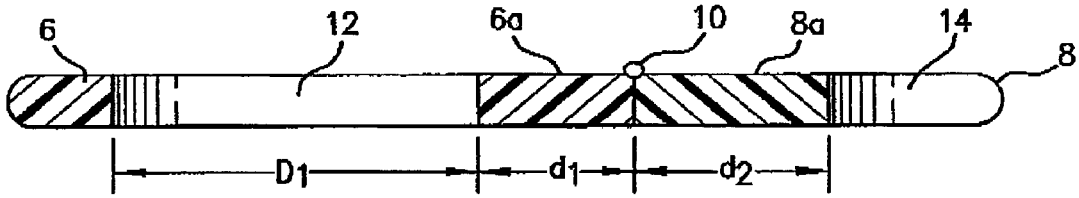
FIG. 4 is a sectional view taken along line 4-4 of FIG. 2.

Referring first more particularly to FIGS. 1 and 2, the bucket stabilizing apparatus 2 of the present invention is designed to stabilize a large cylindrical bucket 4 during the mixing of the fluid contents thereof by conventional motor-operated or manual mixing means (not shown). The stabilizing apparatus includes a base member 6 and a support member 8 having adjacent straight edge portions 6*a* and 8*a* that are pivotally connected together by pivot means 10, specifically, a piano hinge. The base member 6 is normally horizontal and contains a circular opening 12 having a diameter $D_1$ that is slightly greater than the diameter $D_2$ of the bucket 4. The edge of the support member 8 remote from the hinge 10 contains a semi-circular recess 14 having a radius R that is slightly less than one half of the diameter $D_1$ of the opening 12. The center 16 of the radius R of the semi-circular recess 14 and the center of the circular opening 12 are contained in a common vertical plane extending longitudinally of and normal to the stabilizing device 2. According to a characterizing feature of the invention, the distance $d_2$ (FIG. 4) between the pivot axis of the hinge means 10 and the semi-circular recess 14 is greater than the distance $d_1$ between the pivot axis and the circular opening 12. As shown in FIG. 3, this causes the wall of the semi-circular recess 14 to come into clamping engagement with the outer circumferential surface of the bucket when the support member 8 is pivoted toward the illustrated clamping position. The radius R of the semi-circular recess 14 is slightly less than the radius of the circular opening 12.

Preferably, the distance $d_2$ between the hinge axis and the semi-circular recess equals the radius R of the semi-circular recess. Preferably, the base member and support members have generally the same thickness, and are formed from the same material.

Typically, for a 5-gallon bucket 2, the thickness of each of the base and support members is ¾", the width of the adjacent edge portions 6*a* and 8*a* is 14", the length of the piano hinge 10 is 13", the radius of the circular opening 12 is 5¼", the radius R of the semi-circular opening 14 is 5⅛", the distance $d_1$ from the pivot axis to the circular opening 12 is 5", and the distance $d_2$ from the pivot axis to the semi-circular recess is 5⅛". The width of the bifurcated leg portions 8*c* of the support member is about 5", and these leg portions have a radius of curvature of 2½".

In operation, the stabilizing device 2 is laid flat on a horizontal surface S, and the bottom of the bucket 4 is lowered into the circular opening 12. The support member 8 is pivoted about the hinge 10 upwardly from the open flat position of FIGS. 2 and 4 and inwardly toward the clamping position of FIGS. 1 and 3. Since the spacing distance $d_2$ of the semi-circular recess 14 relative to the pivot axis is greater than the spacing distance $d_1$ of the circular opening, the edge of the semi-circular recess comes into clamping engagement with the outer circumferential surface of the bucket 4, as best shown in FIG. 3. When the user steps with one or both feet on the support member 8, the bucket is rigidly clamped within the opening 12 contained in the base member 6. The bucket is thus biased to the left by the weight of the user toward the diametrically opposed wall portion of the circular opening 12, as shown in FIG. 3. With the bucket in the stabilized condition, the bucket may be opened, whereupon the contents of the bucket may now be stirred by suitable mixing means (not shown).

While in accordance with the provisions of the Patent Statutes the preferred forms and embodiments of the invention have been illustrated and described, it will be apparent to those skilled in the art that changes may be made without deviating from the invention described above.

What is claimed is:

1. Bucket stabilizing apparatus for stabilizing a cylindrical bucket during the mixing of the fluid contents thereof, comprising:

(a) a horizontal planar base member containing a circular opening having a diameter ($D_1$) that is slightly greater than the diameter ($D_2$) of the bucket;

(b) a planar support member having opposed first and second edge portions, said second edge portion containing a semi-circular recess having a given radius (R); and (c) pivot means connecting said support member first edge portion with said base member for movement about a horizontal pivot axis that extends normal to the vertical plane that contains the centers of said circular opening and said semi-circular recess, the distance ($d_2$) between said pivot axis and said semi-circular recess being greater than the distance ($d_1$) between said pivot axis and said circular opening, whereby when the bottom of the bucket is inserted within said circular opening, said support member may be pivotally operable by the user toward a clamping position above said base member in which the wall of said semi-circular recess is in clamping engagement with the outer circumferential surface of said bucket.

2. Bucket stabilizing apparatus as defined in claim 1, wherein said base member and said support member having generally the same thickness and include parallel adjacent straight edge portions connected by said pivot means, said support member being pivotally operable between said clamping position and an initial horizontal open position coplanar with said base member.

3. Bucket stabilizing apparatus as defined in claim 2, wherein said pivot means comprises a piano hinge.

4. Bucket stabilizing apparatus as defined in claim 3, wherein said base member and said support member are each formed from a rigid synthetic plastic material.

5. Bucket stabilizing apparatus as defined in claim 1, wherein the radius (R) of said semi-circular recess is equal to the distance ($d_2$) between said pivot axis and said semi-circular recess.

6. Bucket stabilizing apparatus as defined in claim 5, wherein the radius (R) of said semi-circular recess is slightly less than that of said circular opening.

* * * * *